US006381784B1

(12) United States Patent
Davis et al.

(10) Patent No.: US 6,381,784 B1
(45) Date of Patent: May 7, 2002

(54) PILLOW WITH IMPROVED HEAD TRACTION

(75) Inventors: Edmund Scott Davis; Antonio Arcieri, both of Fort Lauderdale, FL (US)

(73) Assignee: Banyan Licensing LLC, Fort Lauderdale, FL (US)

( * ) Notice: Subject to any disclaimer, the term of this patent is extended or adjusted under 35 U.S.C. 154(b) by 0 days.

(21) Appl. No.: 09/398,354

(22) Filed: Sep. 17, 1999

(51) Int. Cl.[7] ..... A47G 9/00
(52) U.S. Cl. ..... 5/636; 5/640; 5/736
(58) Field of Search ..... 5/636, 637, 638, 5/640, 633, 730, 731, 736

(56) References Cited

U.S. PATENT DOCUMENTS

| | | | | | |
|---|---|---|---|---|---|
| 3,753,264 | A | * | 8/1973 | Grenier | 5/636 X |
| 4,218,792 | A | * | 8/1980 | Kogan | 5/636 |
| 4,383,342 | A | | 5/1983 | Forster | |
| 4,726,087 | A | | 2/1988 | Schaefer et al. | |
| 4,832,007 | A | * | 5/1989 | Davis, Jr. et al. | 5/636 X |
| 4,916,765 | A | * | 4/1990 | Castronovo, Jr. | 5/640 |
| 5,211,697 | A | | 5/1993 | Kienlein et al. | |
| D339,020 | S | | 9/1993 | Ward et al. | |
| 5,432,967 | A | * | 7/1995 | Raftery | 5/633 |
| 5,519,907 | A | | 5/1996 | Poths | |
| 5,533,218 | A | * | 7/1996 | Fahy | 5/730 X |
| 5,682,633 | A | * | 11/1997 | Davis | 5/636 |
| 5,797,154 | A | * | 8/1998 | Contreras | 5/636 |

* cited by examiner

*Primary Examiner*—Michael F. Trettel
(74) *Attorney, Agent, or Firm*—Alston & Bird LLP

(57) ABSTRACT

The present invention provides a pillow having raised ribs which are angled at an acute angle with respect to a bottom surface of the pillow and define the upper surface of the pillow contacted by the user's head and neck. The angled ribs provide traction forces to the head and neck of the user. The ribs vary in thickness in the longitudinal direction along which a person's spine is oriented. The pillow preferably has a rear portion for supporting a person's head and a front portion for supporting a person's neck, and the ribs on the rear portion are upwardly inclined toward the rear edge of the pillow and the ribs on the front portion are upwardly inclined toward the front edge of the pillow, so that traction forces on the head and neck are exerted in opposite directions. The pillow preferably also includes a forward extension portion adapted to support the lower neck and central upper back region between the shoulder blades, the extension portion being substantially narrower than the main body portion and also having the angled ribs.

16 Claims, 4 Drawing Sheets

PILLOW WITH IMPROVED HEAD TRACTION

BACKGROUND OF THE INVENTION

1. Field of the Invention

The present invention relates to a pillow having improved head traction. More particularly, this invention relates to a pillow which prevents the user's head and neck from bearing excessive pressure during the night.

2. The Prior Art

There are presently available pillows having contoured surfaces. Such pillows are designed to provide therapeutic relief in the head and neck areas.

U.S. Pat. No. 4,726,087 discloses a contoured head and neck foam pillow which includes longitudinal ribs of arcuate cross section which collectively define a curved pillow profile having at least two prominent lobes of differing heights and a central trough. The ribs are of semi-circular cross section and have circular channels separating their bases to provide a heat and moisture dissipation function. The ribs are generally directed upwardly and the radius of curvature of the ridges varies generally in accordance with the thickness of a predetermined profile of the upper support surface.

Another example of a pillow having a contoured upper surface is shown in U.S. Design Pat. No. 339,020 to Ward which shows longitudinal ribs extending across the upper surface of a pillow having front and back lobes. The ribs are generally vertically upstanding from the upper surface of the pillow, and have alternately varying shapes from one rib to the next.

U.S. Pat. No. 5,519,907 issued to Poths discloses a foam device for relaxing the skeletal muscles of the neck region comprising a mat of foam material with transverse ribs projecting from the upper side, and with one section of the foam mat having the ribs standing obliquely towards the head side and another section of the mat having the ribs standing obliquely towards the foot side, such that the divergently oblique transverse ribs of both foam sections purportedly stretch the spine in two opposite directions and increase the space between the vertebrae to release and soothe pinched nerve ends and overstressed disks.

SUMMARY OF THE INVENTION

The present invention provides a pillow having transversely extending raised ribs across its upper surface with the ribs extending upwardly from the pillow at an acute angle to a bottom surface of the pillow so as to provide traction forces to the user's head and neck. The traction forces are dependant upon the density of the foam used in the various ribs, and the widths and angles of the ribs.

More specifically, the pillow of the present invention comprises a compressible and resilient body including a front portion and a rear portion. The front portion is adapted to support the user's neck with the user's spine extending generally parallel to a longitudinal direction of the body generally from the rear portion to the front portion, the body having a generally planar bottom surface. The body may be formed of a single piece of compressible and resilient material or, alternatively, the body may be formed of a one-piece base portion and a one-piece top portion secured atop the base portion.

At least a portion of the upper surface of the body on which the user's head and neck are supported includes raised ribs extending transversely across the body normal to the longitudinal direction and generally parallel with one another, and each rib extends upwardly from the body at an angle to the bottom surface and terminates at an upper surface. The ribs are located on the body such that one or both of the user's head and neck are supported atop the ribs. At least some of the ribs are angled upwardly and toward the rear edge of the pillow (i.e., in a direction away from the user's feet) such that a traction force is exerted on the user's head and/or neck tending to stretch the user's spine. Advantageously, the widths and/or the heights of the ribs may vary in the longitudinal direction. For example, the ribs may be relatively narrower and/or relatively shorter on one portion of the pillow, and relatively wider and/or relatively taller on another portion so as to create different degrees of support on these portions.

The ribs advantageously form an angle of from about 30° to about 80° with the bottom surface of the pillow. Various rib shapes may be used. In accordance with a preferred embodiment of the invention, each rib has a lower portion having a first thickness measured crosswise to the rib, and an upper portion having a second thickness which is different from the first thickness. For example, the ribs may be configured such that the upper portion has a greater thickness than the lower portion such that open channels are defined between the lower portions of adjacent ribs to facilitate air circulation through the pillow. Alternatively, the ribs may be gradually tapered from their bases toward their upper ends.

In a preferred embodiment of the invention, the pillow may have at least one rounded upwardly protruding lobe which extends across the width of the body.

According to another preferred embodiment of the invention, the rear portion of the compressible body defines a rear edge of the body and the front portion defines a front edge of the body, and at least some of the ribs on the rear portion are upwardly inclined in a rearward direction toward the rear edge and at least some of the ribs on the front portion are upwardly inclined in a forward direction toward the front edge. This arrangement of the ribs facilitates the creation of traction forces by the rear and front portions in opposite directions away from each other, such that a person's head is pulled by the rear portion toward the rear edge and the neck is pulled by the front portion toward the front edge.

Alternatively, the rear portion of the pillow can have ribs that are upwardly inclined in the forward direction and the front portion can have ribs that are upwardly inclined in the rearward direction. A middle portion of the pillow between the front and rear portions can have ribs that extend vertically upward, if desired.

In accordance with a further preferred embodiment of the invention, the body includes an upwardly protruding front lobe formed in the front portion and extending transversely across the width of the body, a forward portion of the front lobe having at least one rib upwardly inclined in the forward direction toward the front edge and a rearward portion of the front lobe having at least one rib upwardly inclined in the rearward direction toward the rear edge. Preferably, the front lobe further includes a wedge-shaped rib whose longitudinal width increases toward the upper surface thereof, the wedge-shaped rib being located between the rearwardly angled rib on the rearward portion and the forwardly angled rib on the forward portion of the front lobe. By so configuring the ribs on the front lobe, the forward portion of the front lobe can apply traction forces to the neck in a direction toward the user's feet and the rearward portion can apply traction forces to the head in the opposite direction so as to create a beneficial stretching of the neck.

In accordance with yet another preferred embodiment of the invention, the pillow includes an extension portion extending longitudinally forward from the front edge of the body and having a transverse width substantially less than the width of the body. The extension portion has transversely extending raised ribs which are upwardly inclined relative to the bottom surface of the body in a direction away from the front edge of the body, whereby the extension portion is adapted to support the lower neck and upper back region of a user and the ribs on the extension portion are adapted to apply a traction force in the direction away from the front edge of the body.

BRIEF DESCRIPTION OF THE DRAWINGS

The above and other objects, features and advantages of the invention will be apparent from the following detailed description of several preferred embodiments of the invention when taken in conjunction with the accompanying drawings, in which.

DETAILED DESCRIPTION OF THE PREFERRED EMBODIMENTS

Figure 1:
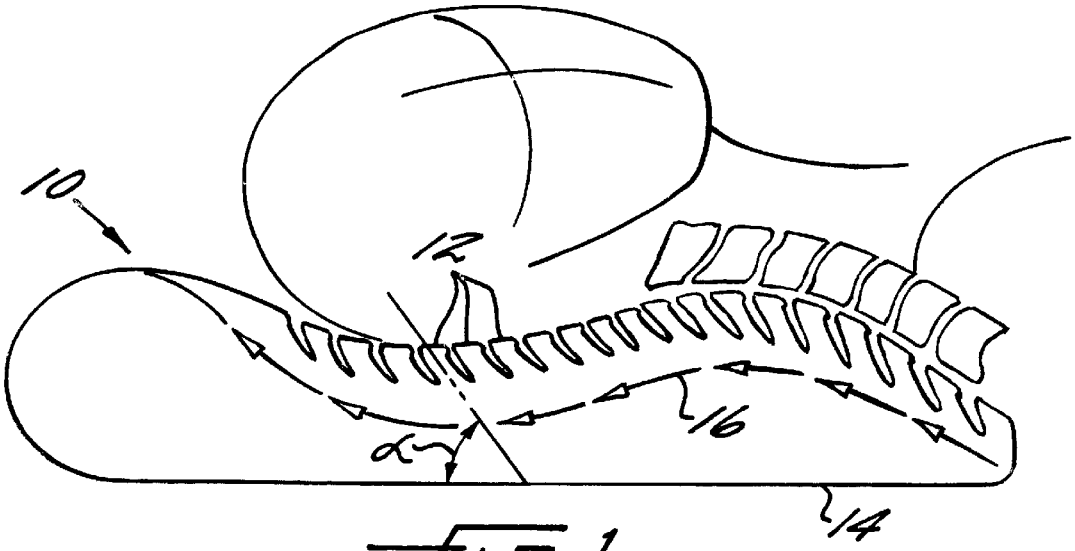
FIG. 1 is a side view of a pillow of an embodiment of the present invention showing the direction of traction forces against the neck and head of the user.

With reference to FIG. 1, a first embodiment of a pillow 10 in accordance with the invention is shown in use supporting the head and neck of a user. The pillow 10 comprises a resilient and compressible body which includes raised ribs 12 which extend upwardly from the pillow to form the upper surface which is contacted by the head and neck of the user. The ribs 12 extend upwardly at an acute angle a to the bottom surface 14 of the pillow 10. The bottom surface 14 is depicted as being planar, but it will be appreciated that the bottom surface 14 may include slight non-planar contouring. In use, the bottom surface 14 will conform to the upper surface of the mattress or other bedding surface, and the ribs 12 will be acutely angled with respect to both the bottom surface 14 and the bedding surface.

As the user's head and neck contact and depress the upper surface of the pillow 10, the ribs 12 are deflected to smaller acute angles, rotating about their bases. Friction between the top surfaces of the ribs 12 and the user's head and neck thus cause traction forces to be applied to the head and neck along the direction indicated by arrows 16. These traction forces are beneficial in many cases for helping to relieve tension in the neck area of the user, thus promoting a more restful sleep.

Figure 2:
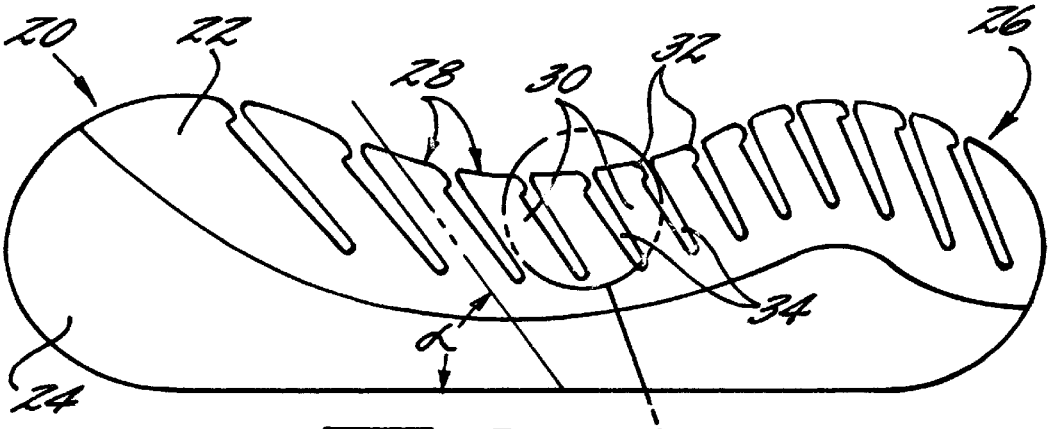
FIG. 2 is a side view of another embodiment of the present invention having a front lobe and being formed of a base portion and a top portion.
Figure 3:
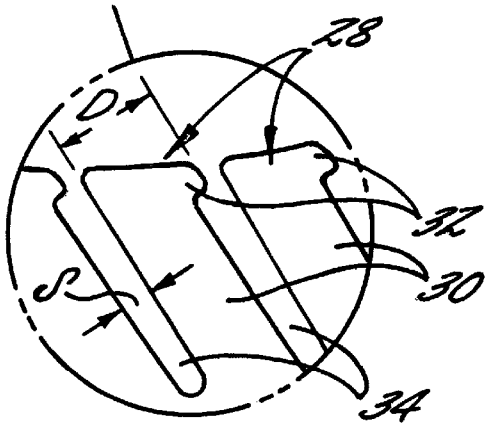
FIG. 3 is an enlarged view of a portion of FIG. 2 showing the angled ribs in greater detail.
Figure 4:
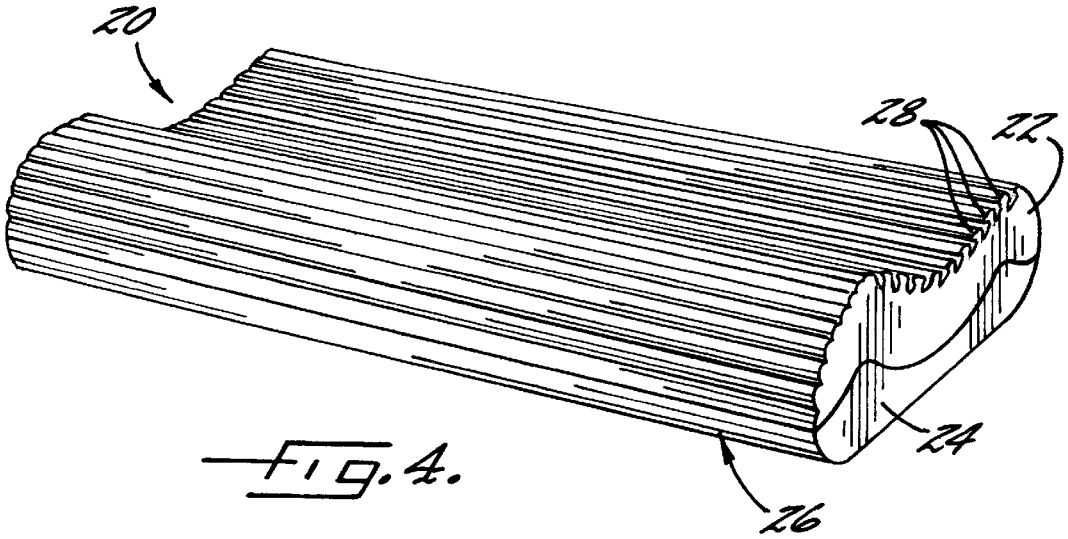
FIG. 4 is a perspective view of the pillow of FIG. 2.

FIG. 2 depicts another embodiment of the invention in which the pillow 20 comprises a top portion 22 and a base portion 24. The pillow 20 also includes a front lobe 26 which protrudes upwardly from the base portion 24 and is configured to provide support for the user's neck. The ribs 28 extend upwardly from the top portion 22. FIG. 3 depicts the ribs 28 in greater detail. Each rib 28 preferably includes a lower portion 30 having a first thickness measured crosswise to the rib, and an upper portion 32 having a second thickness greater than the first thickness. Thus, open channels 34 are defined between the lower portions 30 of adjacent ribs. The open channels 34 facilitate movement of the ribs 28 for providing the traction forces, and also facilitate dispersion of heat away from the user's head and neck.

The ribs 28 preferably have a crosswise dimension or width D measured at the upper portion 32 of about 0.3 to about 1.0 inches, and more preferably about 0.7 inch. Spacing S between adjacent ribs is preferably about 0.2 inch. Each rib 28 makes an angle of about 30° to about 80° with the bottom surface of the pillow. The height of a rib 28 can be defined as the distance from the bottom of the adjacent channel 34 to the top surface of the rib measured along the inclined direction of the rib.

It should be noted that various rib shapes can be used, however, including ribs of constant longitudinal thickness or width, ribs which gradually taper from their bases toward their upper ends, etc. Additionally, the widths and/or heights of the ribs and the spacings between ribs can be varied to provide differing degrees of support. For example, one portion of the pillow can have ribs that are relatively wider and/or relatively narrower than the ribs on another portion of the pillow so as to create differing degrees of support on these two portions.

In accordance with the invention, the pillow can be comprised of a variety of compressible and resilient materials which are known by those who are skilled in the art. For example, foamed plastic and/or foam rubber are desirable, since they provide softness in addition to firmness and resiliency. The pillow top portion and base portion can comprise numerous known densities and compressibilities. Advantageously, the base portion is made of compressible foam having a density from about 1.0 to about 3.0 pounds per cubic foot and an indention force of 10 pounds to 40 pounds at 25% deflection. The top portion includes a foam material having a density of 1.5–7.0 pounds per cubic foot with an indentation force of 6 to 25 pounds at 25% deflection.

Figure 5:
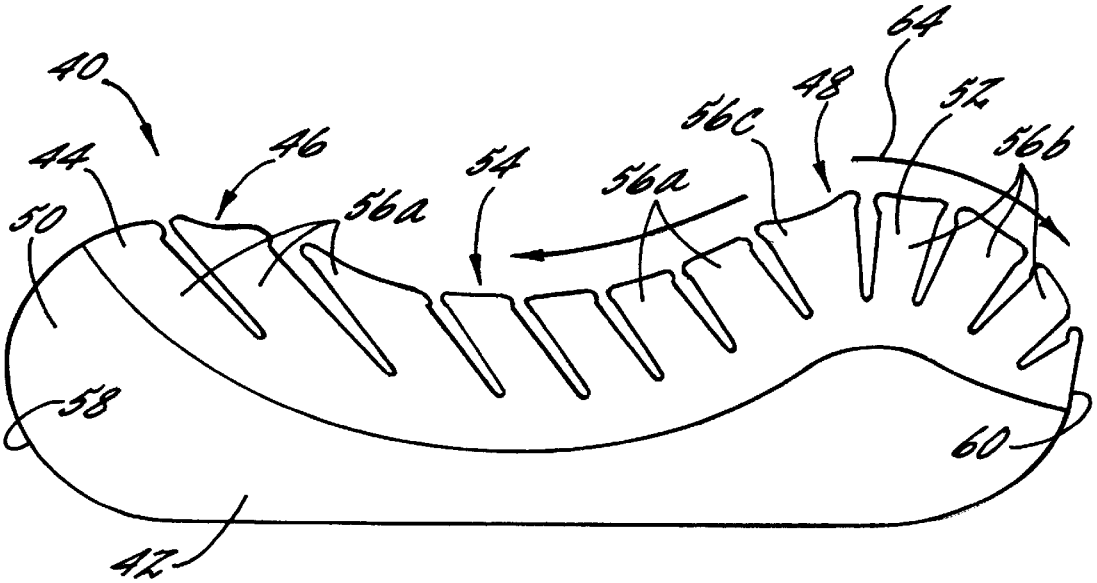
FIG. 5 is a side view of yet another embodiment of the invention having ribs angled in opposite directions for applying traction forces in opposite directions.

FIG. 5 depicts another preferred embodiment of a pillow 40 in accordance with the invention in which there are ribs angled in opposite directions. The pillow 40 is formed of a base portion 42 and a top portion 44, and includes a rear portion 46 configured to support a person's head and a front portion 48 configured to support the neck. The rear portion 46 includes a rear lobe 50 which protrudes upwardly, and the front portion 48 includes a front lobe 52 which protrudes upwardly, both lobes extending across the width of the pillow parallel to each other and together creating a trough 54 between them which cradles a person's head. The rear portion 46 includes ribs **56*a* which are upwardly inclined in the direction toward the rear edge 58 of the pillow, and the front portion 48 includes ribs 56*b* which are upwardly inclined in the direction toward the front edge 60 of the pillow. As shown, the front lobe 52 preferably includes at least one rib 56***a* upwardly inclined in the direction of the rear edge 58, and at least one rib 56*b* upwardly inclined in the direction of the front edge 60. The front lobe 52 also includes a wedge-shaped rib 56*c* whose longitudinal width increases toward the upper end of the rib and which is located between the ribs 56*a* that are rearwardly angled and the ribs 56*b* that are forwardly angled. The wedge-shaped rib 56*c* is needed to insure that the gaps between the ribs at their upper surfaces are generally uniform from front to rear of the pillow. The rearwardly angled ribs 56*a* apply traction force in the direction indicated by arrow 62, while the forwardly angled ribs 56*b* apply traction force in the direction indicated by arrow 64. Thus, a person's head is pulled toward the rear edge 58 while the neck is pulled toward the front edge 60, which stretches the spine in the neck region so that muscular tension is relieved.

Figure 6:
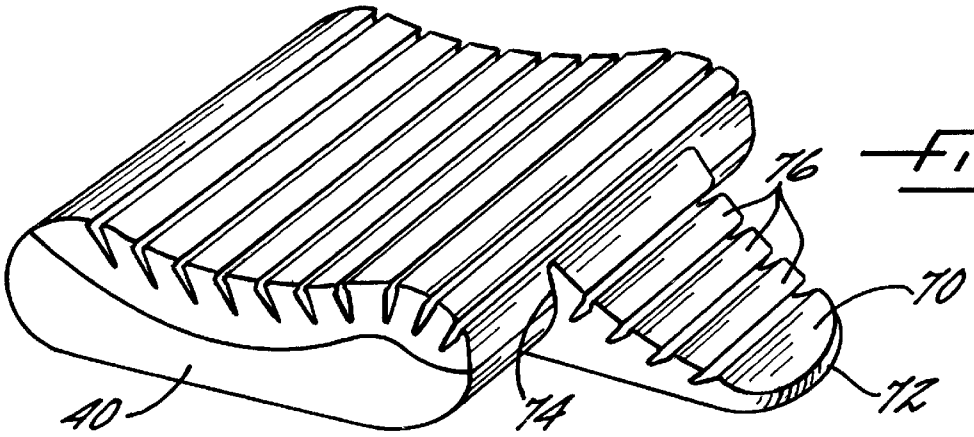
FIG. 6 is a perspective view of still another embodiment of the invention having an extension portion for supporting and applying traction forces to the lower neck and upper back region of a user.
Figure 7:
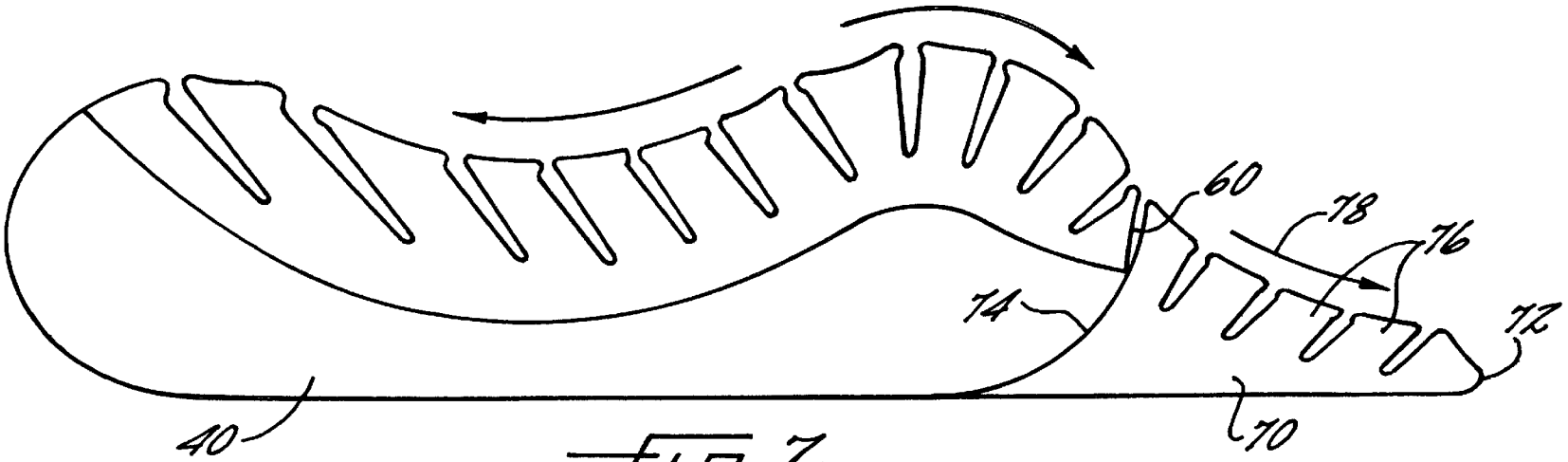
FIG. 7 is a side view of the pillow of FIG. 6.

FIGS. 6 and 7 depict a variation of the pillow of FIG. 5, in which a forward extension portion 70 is attached to the pillow and extends longitudinally forward from the front edge 60. The extension portion 70 has a transverse width which is substantially less than that of the pillow 40, and is shaped generally as a ramp having a minimum height at the forwardmost edge 72 and a maximum height at the rearwardmost edge 74 where the extension portion attaches to the pillow. The forwardmost edge 72 is smoothly rounded, and the transverse width of the extension portion gradually increases toward the rearwardmost edge 74. The extension portion thus is shaped to support the lower neck and central upper back region between the shoulder blades, which on most people tends to form a slight hollow. The extension portion fills in this hollow, so that the entire upper back and lower neck region of the body is more uniformly supported.

The extension portion 70 includes a plurality of ribs 76 which are upwardly inclined in the direction away from the front edge 60 of the pillow 40. The ribs 76 are thus configured to apply traction force in the direction indicated by the arrow 78, so that beneficial traction forces are distributed over a greater length of the spine.

Figure 8:
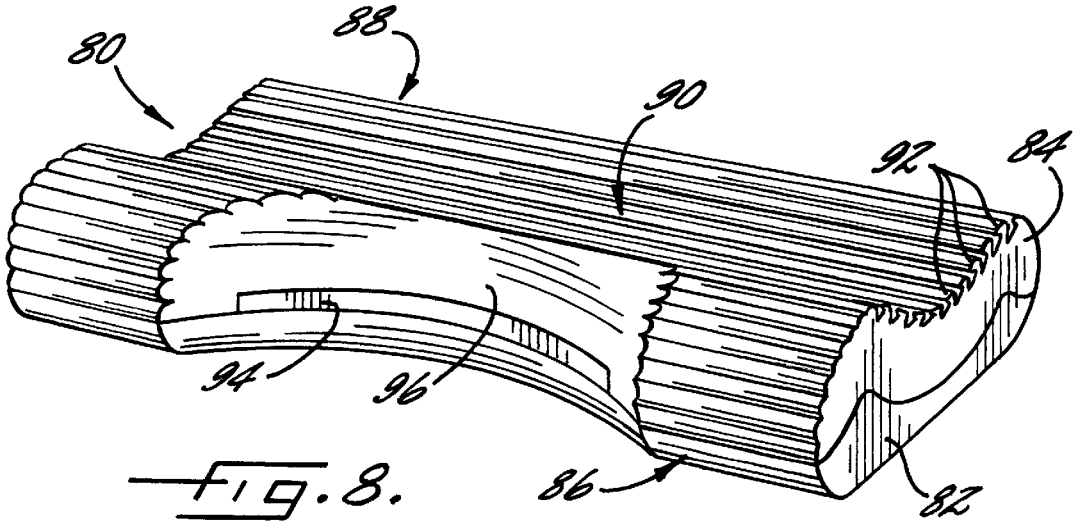
FIG. 8 is a perspective view of a pillow of another embodiment of the present invention having front and rear lobes in which a cut out is formed in the front lobe.

FIG. 8 shows yet another embodiment of a pillow 80 in accordance with the invention having a base portion 82 and a top portion 84, in which the pillow 80 includes both a front lobe 86 and a rear lobe 88, with a trough 90 therebetween to accommodate the user's head. The top portion 84 has a plurality of ribs 92 extending laterally across the width of the top portion 84. The ribs 92 extend upwardly from the bottom of the top portion 84 at an angle from 30° to 80°, preferably about 60°.

The pillow 80 further includes a neck wedge 94 between the top portion and the base portion. The neck wedge 94, of foamed plastic or foam rubber, is provided for enhancing the support given to the user's head. The wedge 94 has a density and compressibility different from the base and top portion, and extends between the base portion and the top portion. Preferably, the wedge 94 has a density of about 1.0 to about 3.8 pounds per cubic foot, and the density of the wedge 94 is greater than that of the base portion 82. The wedge 94 may be thicker at its rearward edge than at its front edge to provide more support to the user's head. The front lobe 86 has a cut out portion 96 to accommodate the shoulder of a person lying on his or her side.

The front and rear lobes 86 and 88 may be of similar or different sizes. In accordance with the invention, the upper surfaces of the lobes are rounded to approximate the curvature of a human neck. Accordingly, the lobes should have a radius of curvature preferably ranging from 2.0 to 4.0 inches measured along an arc running generally crosswise to the ribs 92. More preferably, the radius of curvature should be about 2.6 inches.

To provide variable firmness, the upper and lower portions preferably are of different predetermined compressibilities. Most preferably, and as previously noted, the top portion 84 is softer than the base portion 82 allowing the possibility of greater comfort to the user while still providing suitable underlying firmness.

Figure 9:
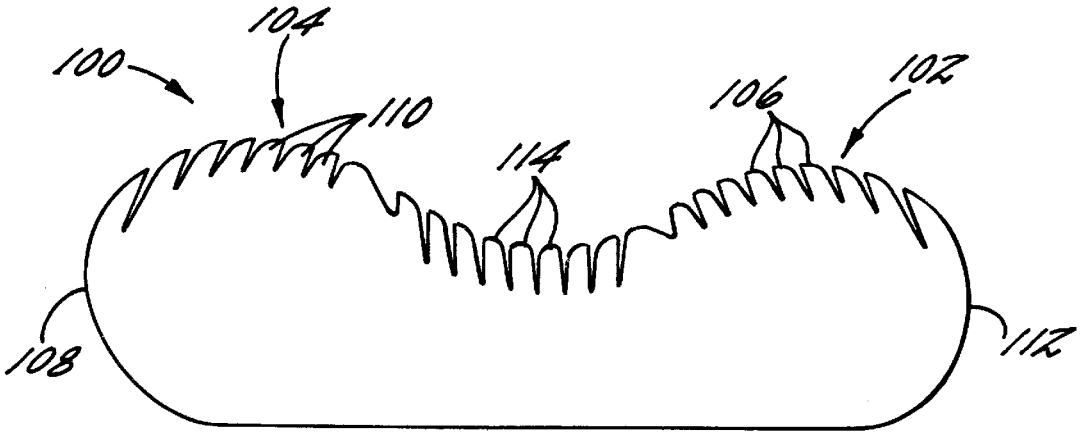
FIG. 9 is a side view of a pillow in accordance with another embodiment of the invention.

FIG. 9 shows yet another embodiment of a pillow in accordance with the present invention. The pillow 100 is generally similar to those already described, and includes a front lobe 102 and a rear lobe 104. The front lobe 102 includes ribs 106 that are upwardly inclined in a rearward direction toward a rear edge 108 of the pillow. The rear lobe 104 includes ribs 110 that are upwardly inclined in a forward direction toward a forward edge 112 of the pillow. A middle portion of the pillow between the front and rear lobes includes ribs 114 that extend vertically upward. A user's neck will be supported atop the ribs 106 on the front lobe, which create a traction force tending to stretch the user's neck away from his or her feet.

From the foregoing description of certain preferred embodiments of the invention, it will be appreciated that the invention provides a pillow having a unique upper surface in which angled ribs act to produce traction forces on a user's head and neck. The invention further provides such a pillow having a lobed configuration for cradling a user's head. Additionally, the invention provides a pillow having the angled ribs and further including an extension portion for supporting and applying traction forces to the lower neck and central upper back region of a person. However, the invention is not limited to pillows having lobes and/or extension portions, and other pillow configurations employing the unique angled ribs of the present invention are considered to be within the scope of the invention.

The invention has been described in detail with particular reference to preferred embodiments, but it is understood that variations, modifications and substitution of equivalent means may be effected within the spirit of this invention. Thus, the scope of the invention, including such modifications and variations, is set forth in the following claims.

What is claimed is:

1. A pillow comprising:

a compressible and resilient body including a front portion and a rear portion, the front portion being adapted to support the user's neck and the rear portion being adapted to support the user's head with the user's spine extending generally parallel to a longitudinal direction of the compressible and resilient body generally from the rear portion to the front portion thereof, the body having a generally planar bottom surface; and the body including raised ribs on at least the front portion the ribs extending transversely across the body normal to the longitudinal direction and generally parallel with one another, at least some of the ribs on the front portion of the pillow being inclined in the longitudinal direction at an acute angle to the bottom surface and terminating at an upper surface, at least some of the inclined ribs on the front portion extending upwardly at acute angles to the bottom surface and toward the rear portion such that the weight of the user's neck on the front portion deflects the ribs with a rearward component of deflection at the upper surfaces of the ribs thereby causing rearward traction forces to be exerted on the user's neck.

2. The pillow according to claim 1, wherein each of the inclined ribs makes an angle of from about 30° to about 80° relative to the bottom surface.

3. The pillow according to claim 1, wherein each of the raised ribs includes a lower portion having a first longitudinal thickness, and an upper portion having a second longitudinal thickness differing from the first thickness.

4. The pillow according to claim 3, wherein the first thickness is greater than the second thickness, such that open channels are defined between the lower portions of adjacent ribs.

5. The pillow according to claim 1, wherein the body includes at least one rounded upwardly protruding lobe extending across the width of the body.

6. The pillow according to claim 1, wherein the rear portion defines a rear edge of the body and the front portion defines a front edge of the body, and wherein at least some of the ribs on the rear portion that support the user's head are upwardly inclined in a rearward direction toward the rear edge so as to create traction forces on the user's head in the rearward direction, and at least some of the ribs on the front portion that support the user's neck are upwardly inclined in a forward direction toward the front edge so as to create traction forces on the user's neck in the forward direction.

7. The pillow according to claim 6, wherein the body includes an upwardly protruding front lobe formed in the front portion and extending transversely across the width of the body, a forward portion of the front lobe having at least one rib upwardly inclined in the forward direction and a rearward portion of the front lobe having at least one rib upwardly inclined in the rearward direction.

8. The pillow according to claim 7, wherein the front lobe further includes a wedge-shaped rib whose longitudinal thickness increases toward the upper surface thereof, the wedge-shaped rib being located between said at least one rib on the rearward portion and said at least one rib on the forward portion of the front lobe.

9. The pillow according to claim 1, further including an extension portion extending longitudinally forward from the front edge of the body and having a transverse width substantially less than the width of the body, the extension portion having transversely extending raised ribs which arc upwardly inclined relative to the bottom surface of the body in a direction away from the front edge of the body, whereby the extension portion is adapted to support the lower neck and central upper back region between the shoulder blades of a user and the ribs on the extension portion are adapted to apply a traction force in said direction away from the front edge of the body.

10. A pillow comprising:

a compressible and resilient body including a rear portion adapted to support a user's head and a front portion adapted to support the user's neck with the user's spine extending generally parallel to a longitudinal direction of the compressible and resilient body generally from the rear portion to the front portion thereof, the body having a generally planar bottom surface and a front edge;

the body including raised ribs extending transversely across the body normal to the longitudinal direction and generally parallel with one another; and an extension portion extending longitudinally forward from the front edge of the body and having a transverse width substantially less than the width of the body, the extension portion having transversely extending raised ribs which are upwardly inclined relative to the bottom surface of the body in a direction away from the front edge of the body, whereby the extension portion is adapted to support the lower neck and central upper back region between the shoulder blades of a user, and the ribs on the extension portion are adapted to apply a traction force in said direction away from the front edge of the body.

11. The pillow of claim 10, wherein the rear portion defines a rear edge of the body and wherein at least some of the ribs on the rear portion are upwardly inclined in a rearward direction toward the rear edge and at least some of the ribs on the front portion are upwardly inclined in a forward direction toward the front edge.

12. The pillow according to claim 10, wherein the body includes an upwardly protruding front lobe formed in the front portion and extending transversely across the width of the body, a forward portion of the front lobe having at least one rib upwardly inclined in the forward direction and a rearward portion of the front lobe having at least one rib upwardly inclined in the rearward direction.

13. The pillow according to claim 12, wherein the front lobe further includes a wedge-shaped rib whose longitudinal thickness increases toward the upper surface thereof, the wedge-shaped rib being located between said at least one rib on the rearward portion and said at least one rib on the forward portion of the front lobe.

14. The pillow of claim 13, wherein the body is formed of a base portion and a top portion secured atop the base portion, the base portion being made of compressible foam having a density from about 1.0 to about 3.0 pounds per cubic foot and an indention force of 10 pounds to 40 pounds at 25% deflection, and the top portion being made of compressible foam having a density of 1.5–7.0 pounds per cubic foot with an indentation force of 6 to 25 pounds at 25% deflection.

15. A pillow comprising:

a compressible and resilient body including a front portion and a rear portion, the front portion being adapted to support the user's neck and the rear portion being adapted to support the user's head with the user's spine extending generally parallel to a longitudinal direction of the compressible and resilient body generally from the rear portion to the front portion thereof, the body having a generally planar bottom surface and a front edge and a rear edge;

the rear portion of the body including raised ribs extending transversely across the body normal to the longitudinal direction and generally parallel with one another, the ribs on the rear portion that support the user's head extending upwardly from the body at an acute angle to the bottom surface in a rearward direction toward the rear edge such that the weight of the user's head on the rear portion deflects the ribs with a component of deflection in the rearward direction at upper surfaces of the ribs so as to create traction forces on the user's spine in the rearward direction, and wherein ribs are formed on the front portion of the pillow, at least some of the ribs on the front portion being upwardly inclined in a rearward direction toward the rear edge so as to create traction forces on the user's neck in the rearward direction.

16. A pillow for creating traction forces on a user's body, the pillow having a symmetrical configuration such that it can be used in either of two positions rotated 180 degrees relative to each other, the pillow comprising:

a resilient and compressible body having a length extending in a longitudinal direction from a front edge toward a rear edge of the body and having a width extending in a transverse direction, the body having an upper surface for supporting the user's head and neck and an opposite bottom surface that is generally planar when the pillow is in use supported atop a planar surface, the body having a middle portion for supporting the user's head, a first neck-supporting portion disposed between the middle portion and the front edge of the body, and a second neck-supporting portion disposed between the middle portion and the rear edge of the body;

the body having transversely extending ribs on both neck-supporting portions, the ribs on the first neck-supporting portion being inclined upwardly toward the rear edge of the body at an acute angle to the planar bottom surface of the body, the ribs on the second neck-supporting portion being inclined upwardly toward the front edge of the body at an acute angle to the planar bottom surface of the body, whereby the user can use the pillow either in a first position wherein the user's neck is supported by the first neck-supporting portion and the user's head is supported by the middle portion, or in a second position rotated 180 degrees from the first position wherein the user's neck is supported by the second neck-supporting portion and the user's head is supported by the middle portion, and in either position the weight of the user's neck on the ribs causes upper surfaces of the ribs to deflect with a generally horizontal component of deflection from the user's feet toward the user's head so as to exert traction forces on the user's spine.

* * * * *